US007760112B2

(12) United States Patent
Bauchot et al.

(10) Patent No.: US 7,760,112 B2
(45) Date of Patent: Jul. 20, 2010

(54) SYSTEM AND METHOD BASED ON SHORT RANGE WIRELESS COMMUNICATIONS FOR NOTIFYING DRIVERS OF ABNORMAL ROAD TRAFFIC CONDITIONS

(75) Inventors: Frederic Bauchot, Saint-Jeannet (FR); Gerard Marmigere, Drap (FR)

(73) Assignee: International Business Machines Corporation, Armonk, NY (US)

( * ) Notice: Subject to any disclaimer, the term of this patent is extended or adjusted under 35 U.S.C. 154(b) by 310 days.

(21) Appl. No.: 11/739,841

(22) Filed: Apr. 25, 2007

(65) Prior Publication Data

US 2007/0279251 A1 Dec. 6, 2007

(30) Foreign Application Priority Data

May 30, 2006 (EP) ..... 06300535

(51) Int. Cl.
*G08G 1/09* (2006.01)

(52) U.S. Cl. ..... 340/905; 340/995.13; 701/119

(58) Field of Classification Search ..... 340/905, 340/995.13, 995.24; 701/119
See application file for complete search history.

(56) References Cited

U.S. PATENT DOCUMENTS 5,428,544 A * 6/1995 Shyu ..... 701/117
6,092,020 A 7/2000 Fastenrath et al.
6,150,961 A 11/2000 Alewine et al.
6,708,107 B2 3/2004 Impson et al.
6,862,500 B2 3/2005 Tzamaloukas
2002/0030611 A1 * 3/2002 Nuesser et al. ..... 340/992

FOREIGN PATENT DOCUMENTS

CN 1534553 A 10/2004
JP 2002234411 A 8/2002
WO WO 2004/036815 A2 4/2004

* cited by examiner

*Primary Examiner*—George A Bugg
*Assistant Examiner*—Hongmin Fan
(74) *Attorney, Agent, or Firm*—Ronald Kaschak; Hoffman Warnick LLC

(57) ABSTRACT

The present invention predicts traffic conditions based on traffic information exchanged by means of short range wireless communications, between vehicles moving in an opposite direction. A method in accordance with an embodiment of the present invention includes: successively recording traffic information based on traffic encountered by the vehicle; sending the traffic information to vehicles moving in the opposite direction; receiving traffic information from vehicles moving in the opposite direction; consolidating the traffic information received from the vehicles; and predicting traffic conditions based on the consolidated traffic information.

19 Claims, 4 Drawing Sheets

SYSTEM AND METHOD BASED ON SHORT RANGE WIRELESS COMMUNICATIONS FOR NOTIFYING DRIVERS OF ABNORMAL ROAD TRAFFIC CONDITIONS

FIELD OF THE INVENTION

The present invention is directed to security computer systems embarked in vehicles and more particularly to a method, system and computer program based on short range wireless communications for notifying vehicle drivers about abnormal road traffic conditions and situations.

BACKGROUND OF THE INVENTION

The announcement of abnormal road traffic conditions, such as a traffic jam, an accident, or a sudden traffic speed decrease is very important to limit the number of accidents on the road. On some highways, dedicated systems are in place for detecting some of these conditions, typically traffic jam conditions. These systems rely on different infrastructure means, such as speed sensors, video surveillance equipment, and information boards to announce abnormal traffic conditions. A problem is that such infrastructure means are expensive to deploy and to maintain. Furthermore they cannot react very quickly to sudden conditions, and they cannot react accurately to traffic conditions with a limited impact on the road.

SUMMARY OF THE INVENTION

The present invention relates to a method executed in a vehicle, for predicting traffic conditions based on traffic information exchanged using short range wireless communications, between vehicles moving in an opposite direction. A method in accordance with an embodiment of the present invention comprises: successively recording traffic information based on traffic encountered by the vehicle; sending the traffic information to vehicles moving in the opposite direction; receiving traffic information from vehicles moving in the opposite direction; consolidating the traffic information received from the vehicles; and predicting traffic conditions based on the consolidated traffic information.

The present invention provides numerous advantages, including, but not limited to:

(A) The present invention does not require any dedicated infrastructure, and can therefore be deployed on any type of road (i.e., not limited to highways and the like).

(B) The present invention can be implemented with affordable means.

(C) The present invention can react very quickly to abnormal traffic situations.

(D) The present invention can react quickly, even for a situation having a limited impact on the road (a single vehicle blocking the traffic lane can be detected).

The foregoing, together with other aspects, features, and advantages of this invention can be better appreciated with reference to the following specification, claims and drawings.

BRIEF DESCRIPTION OF THE DRAWINGS

These and other features of this invention will be more readily understood from the following detailed description of the various aspects of the invention taken in conjunction with the accompanying drawings.

DETAILED DESCRIPTION OF THE INVENTION

The following description is presented to enable one or ordinary skill in the art to make and use the invention and is provided in the context of a patent application and its requirements. Various modifications to the embodiment(s) disclosed herein and the generic principles and features described herein will be readily apparent to those skilled in the art. Thus, the present invention is not intended to be limited to the embodiment(s) shown but is to be accorded the widest scope consistent with the principles and features described herein.

A proposed solution for solving the previously mentioned problems and others, is based on an embarked device, named a "Traffic Manager" or "TM" for short, which operates according to the following principles.

Figure 1:
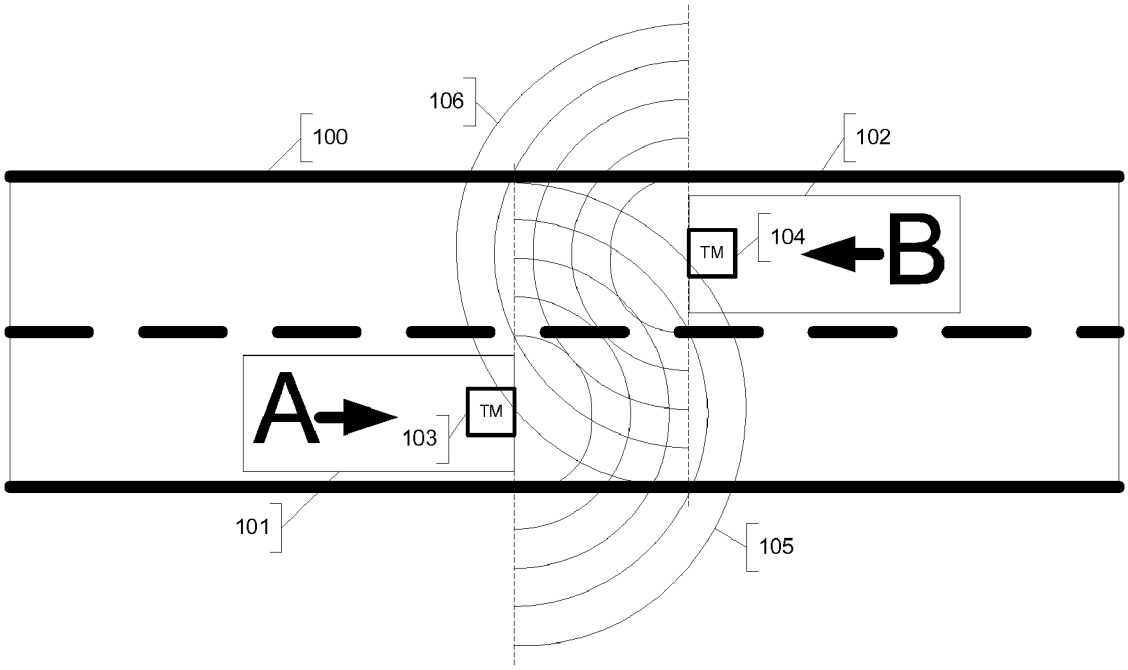
FIG. 1 shows the general principles of an embodiment of the present invention.

Each TM is equipped with short range wireless communication means allowing exchange information with other vehicles. Such wireless communications means are directive (the beam does not cover 360°) to limit the exchange of information between vehicles moving in opposite directions. The maximum range of such wireless communication means is sufficient to allow two crossing vehicles to send and receive a limited volume data. This is illustrated on the FIG. 1 where the vehicle A 101 and the vehicle B 102 exchange information on the road 100. In an embodiment of the present invention, a TM is mounted at the front of each vehicle (respectively shown as 103 and 104 for the vehicles A 101 and B 102), and has a beam of 180° (respectively shown as 105 and 106 for the vehicles A 101 and B 102), covering the area ahead of the vehicle.

Each vehicle A 101 and B 102 knows at any time its current speed, "S". This information is shared with the respective TM.

Each TM generates, when the vehicle is started, a random number that will be used as an identifier, "ID". Having this random number long enough virtually ensures that this identifier is unique. In an alternate embodiment of the present invention, this identifier can be a fixed unique number associated with each vehicle. Nevertheless this alternative may raise concerns with respect to some national regulations on privacy.

Figure 2:
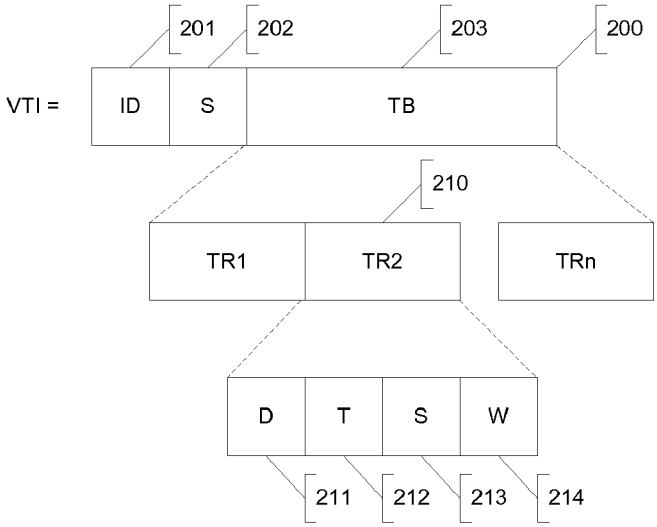
FIG. 2 shows how the vehicle traffic information according to an embodiment of the present invention is structured.

Each TM broadcasts at periodic intervals, using short range wireless communication means, vehicle traffic information 200, "VTI", structured according to the diagram described in FIG. 2:

$$VTI=ID+S+TB$$

$$TB=\{TRi\}$$

$$TRi=D+T+S+W$$

The VTI 200 is structured as a set of three fields, including an identifier "ID" 201 field, an own speed "S" 202 field, and a traffic book "TB" 203 field. The traffic book "TB" 203 is constituted by a sequence of traffic records "TRi" 210, each comprising four fields, respectively containing information on distance "D" 211, time "T" 212, speed "S" 213, and weight "W" 214.

Each TM continuously updates the fields within each TR 210, so that these fields contain accurate information at any point in time. Furthermore, an aging mechanism is run in the TM to cancel any TR 210 holding information considered as being too old.

Each TM manages a traffic prediction pattern, or "TPP" for short, which is built on the basis of the VTI information received from crossing vehicles. The purpose of this TPP is to identify any abnormal traffic condition ahead of the vehicle. When such an abnormal traffic condition is identified, the TM warns the driver through audible and/or visible means. Each TPP is constituted by a sequence of TR following the structure specified above.

Figure 3:
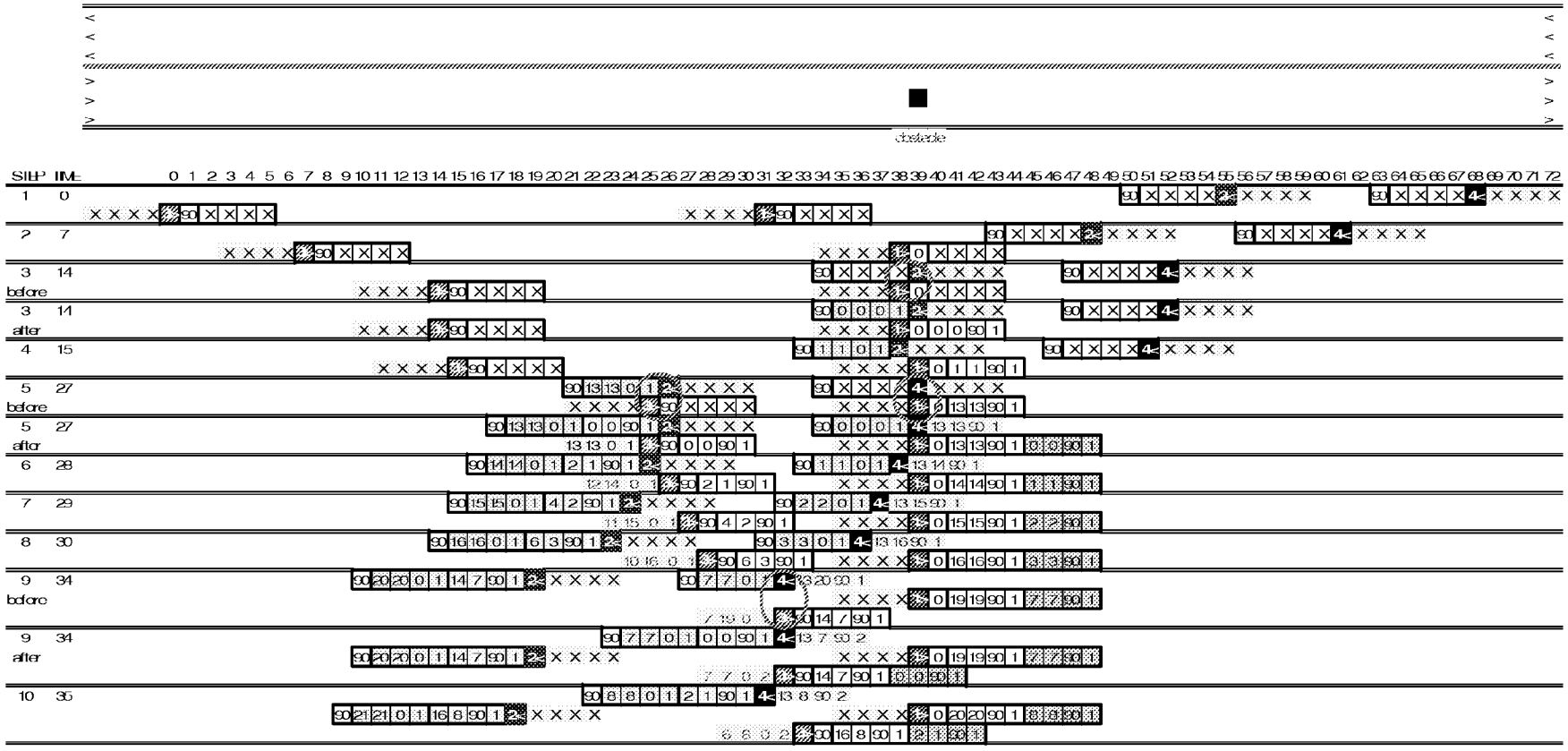
FIG. 3 shows a scenario involving four vehicles.

These principles will be better understood by means of a scenario illustrating how the present invention operates. One scenario, shown in FIG. 3, involves four vehicles:

Vehicles 1 and 3 moving from the left to the right; and

Vehicles 2 and 4 moving from the right to the left.

The position of the vehicles is determined using a scale ranging from 0 to 72. For each vehicle, the diagram shows the broadcast information in front of the vehicle (that is the VTI 200, but where the ID 201 is not shown for keeping the diagram easy to read), and the TPP information behind the vehicle. When TR are void, they are shown as holding a "X". It is assumed that at the beginning of the scenario, all vehicles have not yet crossed any other vehicle, so that their respective VTI and TPP are empty. An obstacle is present at position 39.

Scenario for Vehicle 1

At step 1, the vehicle is at position 31 and moves to the right with a speed of 90 km/h. This vehicle broadcasts a VTI1=(ID1 (not shown on FIG. 3), S1=90, TB1=void). The time reference is set equal to 0.

At step 2, the vehicle is blocked by an obstacle at position 38. Its speed S becomes 0 km/h. Time is equal to 7. The vehicle broadcast a new VTI1=(ID1, S1=0, TB1=void).

At step 3, the vehicle is still blocked, and broadcasts the same VTI1 as before. Time is equal to 14. The vehicle receives the VTI issued by vehicle 2: VTI2=(ID2, S2=90, TB2=void). This VTI2 is processed, so that the vehicle broadcasts a new VTI1=(ID1, S1=0, TB1=[D=0, T=0, S=90, W=1]). This TB1 reflects that a vehicle at a distance 0, since a time 0 is moving with a speed 90 km/h, based on a single piece of information.

At step 4, the vehicle is still blocked, now on the obstacle in position 39. Time is equal to 15. The vehicle broadcasts a VTI1 updated from the previous one: VTI1=(ID1, S1=0, TB1=[D=1, T=1, S=90, W=1]). This TB1 reflects that a vehicle at a distance 1, since a time 1 is moving with a speed 90 km/h, based on a single piece of information.

At step 5, the vehicle is still blocked. Time is equal to 27. The vehicle broadcasts a an updated VTI1: VTI1=(ID1, S1=0, TB1=[D=13, T=13, S=90, W=1]). This TB1 reflects that a vehicle at a distance 13, since a time 13 is moving with a speed 90 km/h, based on a single piece of information. The vehicle receives the VTI issued by vehicle 4: VTI4=(ID4, S4=90, TB4=void). This VTI4 is processed, so that the vehicle broadcasts a new VTI1=(ID1, S1=0, TB1=[D=13, T=13, S=90, W=1] [D=0, T=0, S=90, W=1]). This TB1 reflects that a first vehicle at a distance 13, since a time 13 is moving with a speed 90 km/h, based on a single piece of information, and that a second vehicle at a distance 0, since a time 0 is moving with a speed 90 km/h, based on a single piece of information.

At the following steps, the vehicle remains blocked in position 39 with a speed equal to zero. The vehicle continues to broadcast an updated VTI1, by updating the D and T fields of the TR within the TB. As the vehicle has not received any VTI carrying a TB, its TPP remains void.

Scenario for Vehicle 2

At step 1, the vehicle is at position 55 and moves to the left with a speed of 90 km/h. It broadcasts a VTI2=(ID2 (not shown on the FIG. 3), S2=90, TB2=void). The time reference is set equal to 0.

At step 2, the vehicle is at position 48 and moves to the left with a speed of 90 km/h. It broadcasts the same VTI2=(ID2, S2=90, TB2=void). The time reference is set equal to 7.

At step 3, the vehicle is at position 39 and moves to the left with a speed of 90 km/h. It broadcasts the same VTI2=(ID2, S2=90, TB2=void). The time reference is set equal to 14. The vehicle receives the VTI issued by vehicle 1: VTI1=(ID1, S1=0, TB1=void). This VTI1 is processed, so that the vehicle broadcasts a new VTI2=(ID2, S2=90, TB2=[D=0, T=0, S=0, W=1]). This TB2 reflects that a vehicle at a distance 0, since a time 0 is moving with a speed of 0 km/h, based on a single piece of information.

At step 4, the vehicle is still moving forward with the same speed of 90 km/h, now at the position 38. Time is equal to 15. The vehicle broadcasts a VTI2 updated from the previous one: VTI2=(ID2, S2=90, TB2=[D=1, T=1, S=0, W=1]). This TB2 reflects that a vehicle at a distance 1, since a time 1 is stopped with a speed 0 km/h, based on a single piece of information.

At step 5, the vehicle is still moving with a speed of 90 km/h. Time is equal to 27. The vehicle broadcasts a VTI2 updated from the previous one: VTI2=(ID2, S2=90, TB2=[D=13, T=13, S=0, W=1]). This TB2 reflects that a vehicle at a distance 13, since a time 13 is stopped with a speed 0 km/h, based on a single piece of information. The vehicle receives the VTI issued by vehicle 3: VTI3=(ID3, S3=90, TB4=void). This VTI3 is processed, so that the vehicle broadcasts a new VTI2=(ID2, S2=90, TB2=[D=13, T=13, S=0, W=1][D=0, T=0, S=90, W=1]). This TB2 reflects that a first vehicle at a distance 13, since a time 13 is stopped with a speed of 0 km/h, based on a single piece of information, and that a second vehicle at a distance 0, since a time 0 is moving with a speed 90 km/h, based on a single piece of information.

At the following steps, the vehicle continues to move to the left at a speed of 90 km/h. It continues to broadcast a VTI2 updated from the previous one, by updating the D and T fields of the TR within the TB. As the vehicle has not received any VTI carrying a TB, its TPP remains void.

Scenario for Vehicle 3

At step 1, the vehicle is at position 0 and moves to the right with a speed of 90 km/h. It broadcasts a VTI3=(ID3 (not shown on the FIG. 3), S3=90, TB3=void). The time reference is set equal to 0.

At steps 2, 3 and 4, the vehicle moves at the same speed to positions 7, 14, and 15. It broadcasts the same VTI3=(ID3, S3=90, TB3=void). The time reference becomes 15.

At step 5, the vehicle is still moving with a speed of 90 km/h. Time is equal to 27. The vehicle broadcasts the same VTI3=(ID3, S3=90, TB3=void). The vehicle receives the VTI issued by vehicle 2: VTI2=(ID2, S2=90, TB2=[D=13, T=13, S=0, W=1]). This VTI2 is processed, so that the vehicle broadcasts a new VTI3=(ID3, S3=90, TB3=[D=0, T=0, S=90, W=1]). This TB3 reflects that a vehicle at a distance 0, since a time 0 is moving with a speed of 90 km/h, based on a single piece of information. Furthermore, as a non void TB2 has been received, the vehicle update its TPP with the received TB2: TPP3=[D=13, T=13, S=0, W=1]. This TPP3 means that at a distance of 13, since a time 13, a vehicle running at speed 0 km/h has been detected, based on a single piece of information. This causes a first level of warning to be given to the driver of the vehicle, as a potential danger.

At step 6, the vehicle is still moving to the right with the same speed of 90 km/h, now at the position 26. Time is equal to 28. The vehicle broadcasts a VTI3 updated from the previous one: VTI3=(ID3, S3=90, TB3=[D=2, T=1, S=90, W=1]). This TB3 reflects that a vehicle at a distance 2, since a time 1 is moving at a speed of 90 km/h, based on a single piece of information. Furthermore the TPP fields are updated from their previous values, so that they become: TPP3=[D=12, T=14, S=0, W=1]. This TPP3 means that at a distance of 12, since a time 14, a vehicle running at speed 0 km/h has been detected, based on a single piece of information. This causes a first level of warning to be given to the driver of the vehicle, as a potential danger.

At steps 7 and 8, the vehicle is still moving to the right with the same speed of 90 km/h, reaching the position 28. The vehicles continues to broadcast a VTI3 updated from the previous ones, and to update the TPP3 updated from the previous ones.

At step 9, the vehicle reaches the position 32 and the time is equal to 34. The VTI3 has been updated as VTI3=(ID3, S3=90, TB3=[D=14, T=7, S=90, W=1]). This TB3 reflects that a vehicle at a distance 14, since a time 7 is moving at a speed of 90 km/h, based on a single piece of information. Furthermore the TPP fields are updated from their previous values, so that they become: TPP3=[D=7, T=19, S=0, W=1]. This TPP3 means that at a distance of 7, since a time 19, a vehicle running at speed 0 km/h has been detected, based on a single piece of information. This causes a first level of warning to be given to the driver of the vehicle, as a potential danger. Then the vehicle receives the VTI issued by vehicle 4: VTI4=(ID4, S4=90, TB4=[D=7, T=7, S=0, W=1]). This VTI4 is processed, so that the vehicle broadcasts a new VTI3=(ID3, S3=90, TB3=[D=14, T=7, S=90, W=1][D=0, T=0, S=90, W=1]). This TB3 reflects that a first vehicle at a distance 14, since a time 7 is moving with a speed of 90 km/h, based on a single piece of information, and that a second vehicle at a distance 0, since a time 0 is moving with a speed of 90 km/h, based on a single piece of information. Furthermore, as a non void TB4 has been received, the vehicle update its TPP with the received TB4: TPP3=[D=7, T=7, S=0, W=2]. Here the received TB4 has confirmed the information previously received in TB2 as they both specify a danger at the same distance. This TPP3 means that at a distance of 7, since a time 7, a vehicle running at speed 0 km/h has been detected, based on two different pieces of information. This causes a second level of warning to be given to the driver of the vehicle, as a high potential danger.

At step 10, the vehicle is still moving to the right with the same speed of 90 km/h, reaching the position 33. The vehicles continues to broadcast a VTI3 updated from the previous ones, and to update the TPP3 updated from the previous ones. The second level of warning is still present, pushing the vehicle driver to brake.

Scenario for Vehicle 4

At step 1, the vehicle is at position 68 and moves to the left with a speed of 90 km/h. It broadcasts a VTI4=(ID4 (not shown on the FIG. 3), S4=90, TB4=void). The time reference is set equal to 0.

At steps 2, 3 and 4, the vehicle moves at the same speed to positions 61, 52, and 51. It broadcasts the same VTI4=(ID4, S4=90, TB4=void). The time reference becomes 15.

At step 5, the vehicle is still moving with a speed of 90 km/h. Time is equal to 27. The vehicle broadcasts the same VTI4=(ID4, S4=90, TB4=void). The vehicle receives the VTI issued by vehicle 1: VTI1=(ID1, S1=0, TB1=[D=13, T=13, S=90, W=1]). This VTI1 is processed, so that the vehicle broadcasts a new VTI4=(ID4, S4=90, TB4=[D=0, T=0, S=0, W=1]). This TB4 reflects that a vehicle at a distance 0, since a time 0 is stopped with a speed of 0 km/h, based on a single piece of information. Furthermore, as a non void TB1 has been received, the vehicle update its TPP with the received TB1: TPP4=[D=13, T=13, S=90, W=1]. This TPP4 means that at a distance of 13, since a time 13, a vehicle running at speed 90 km/h has been detected, based on a single piece of information. This does not constitute (yet) a danger as this corresponds to a vehicle running ahead at the same speed.

At step 6, the vehicle is still moving to the left with the same speed of 90 km/h, now at the position 38. Time is equal to 28. The vehicle broadcasts a VTI4 updated from the previous one: VTI4=(ID4, S4=90, TB4=[D=1, T=1, S=0, W=1]). This TB4 reflects that a vehicle at a distance 1, since a time 1 is stopped with a speed of 0 km/h, based on a single piece of information. Furthermore the TPP fields are updated from their previous values, so that they become: TPP4=[D=13, T=14, S=90, W=1]. This TPP4 means that at a distance of 13, since a time 14, a vehicle running at speed 90 km/h has been detected, based on a single piece of information. This still does not constitute a potential danger.

At steps 7 and 8, the vehicle is still moving to the left with the same speed of 90 km/h, reaching the position 36. The vehicles continues to broadcast a VTI4 updated from the previous ones, and to update the TPP4 updated from the previous ones.

At step 9, the vehicle reaches the position 32 and the time is equal to 34. The VTI4 has been updated as VTI4=(ID4, S4=90, TB4=[D=7, T=7, S=0, W=1]). This TB4 reflects that a vehicle at a distance 7, since a time 7 is stopped with a speed of 0 km/h, based on a single piece of information. Furthermore the TPP fields are updated from their previous values, so that they become: TPP4=[D=13, T=20, S=90, W=1]. This TPP4 means that at a distance of 13, since a time 20, a vehicle running at speed 90 km/h has been detected, based on a single piece of information. This still does not constitute a potential danger. Then the vehicle receives the VTI issued by vehicle 3: VTI3=(ID3, S3=90, TB3=[D=14, T=7, S=90, W=1]). This VTI3 is processed, so that the vehicle broadcasts a new VTI4=(ID4, S4=90, TB4=[D=7, T=7, S=0, W=1][D=0, T=0, S=90, W=1]). This TB4 reflects that a first vehicle at a distance 7, since a time 7 is stopped with a speed of 0 km/h, based on a single piece of information, and that a second vehicle at a distance 0, since a time 0 is moving with a speed of 90 km/h, based on a single piece of information. Furthermore, as a non void TB3 has been received, the vehicle update its TPP with the received TB3: TPP4=[D=13, T=7, S=90, W=2]. Here the received TB3 has confirmed the information previously received in TB1 as they both specify a vehicle at almost the same distance. This TPP4 means that at a distance of 13, since a time 7, a vehicle running at speed 90 km/h has been detected, based on two different pieces of information. This still does not constitute a potential danger.

At step 10, the vehicle is still moving to the left with the same speed of 90 km/h, reaching the position 31. The vehicles continues to broadcast a VTI4 updated from the previous ones, and to update the TPP4 updated from the previous ones.

Alternate Embodiments

Without departing from the spirit of the present invention, some enhancements can be proposed along the following points.

The structure of the TR 210 can be completed with a new field named "Information" (or "I" for short) where some specific information can be exchanged from a sending TM to a receiver TM. The I field can carry information, thanks to a pre-defined encoding scheme, such as:

(A) Sudden deceleration of the vehicle. Here this will help discriminating for instance between a vehicle which has stopped at a green light (according to a relatively smooth deceleration), and a vehicle which has suddenly braked to avoid an obstacle on the road.

(B) The sending vehicle has turned on its warning lights, for advertising a danger.

The sending vehicle is experiencing some malfunction that have been detected by an embarked logic.

Each vehicle can record a "Road Book" (RB for short) as a finite set of TR 210 where information describing the road profile is recorded. By broadcasting this RB along with the VTI, a receiving vehicle may learn the next to come profile of the road, with for instance information related to speed, or even with additional relation related for instance to any curve or hairpin bend. This would just need to extend the definition of associated TR, by introducing for instance a new field related to the wheel orientation.

Traffic Manager

Figure 4:
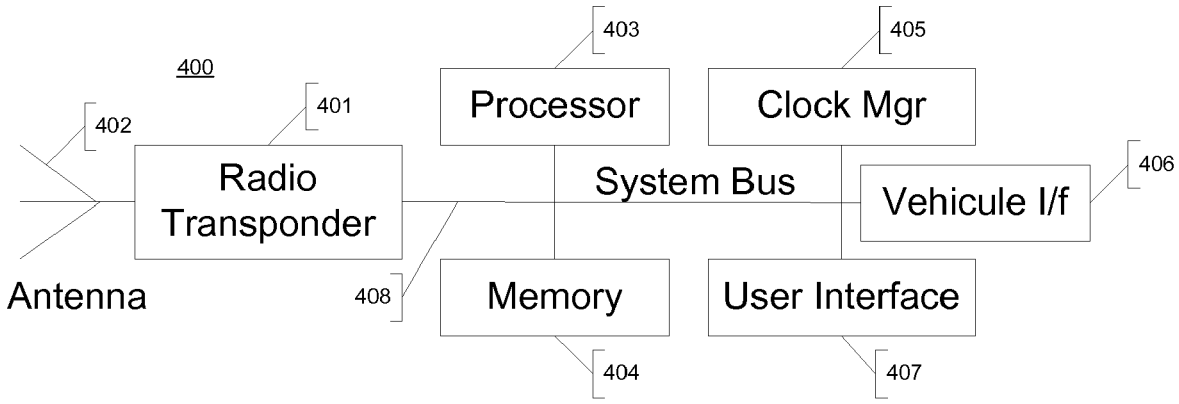
FIG. 4 describes components of the traffic manager according to an embodiment of the present invention.

The traffic manager 400 (TM) is depicted in FIG. 4. In an embodiment of the present invention, the TM 400 comprises a radio transponder 401, a processor 403, a system bus 408, a memory 404, a clock manager 405, a vehicle interface 406, and a user interface 407

The radio transponder 401, with its associated antenna 402, is used for the sending and receiving of VTI. Upon reception of a VTI sent by another vehicle, the radio transponder 401 issues an event "VTI_Received(VTI)", received by the TM logic running in the processor 403.

The processor 403, with its embarked logic, handles of the different events received from the TM (received VTI, timer ticks, vehicle information, etc.) according to the proposed invention. The processor 403 interacts with the other components through a system bus 408.

The memory 404 holds the micro-code implementing the proposed invention, as well as the different pieces of information (VTI, TPP, etc.).

The clock manager 405 provides a master clock and generates associated timer tick events. Here it is assumed that the clock manager 405 issues at regular time intervals, of duration TI, a "Timer_Click" event, received by the TM logic running in the processor 403.

The vehicle interface 406 is used to retrieve information from the car, namely the current speed. The user interface 407 is used to warn the vehicle driver, should a traffic information being detected.

Figure 5:
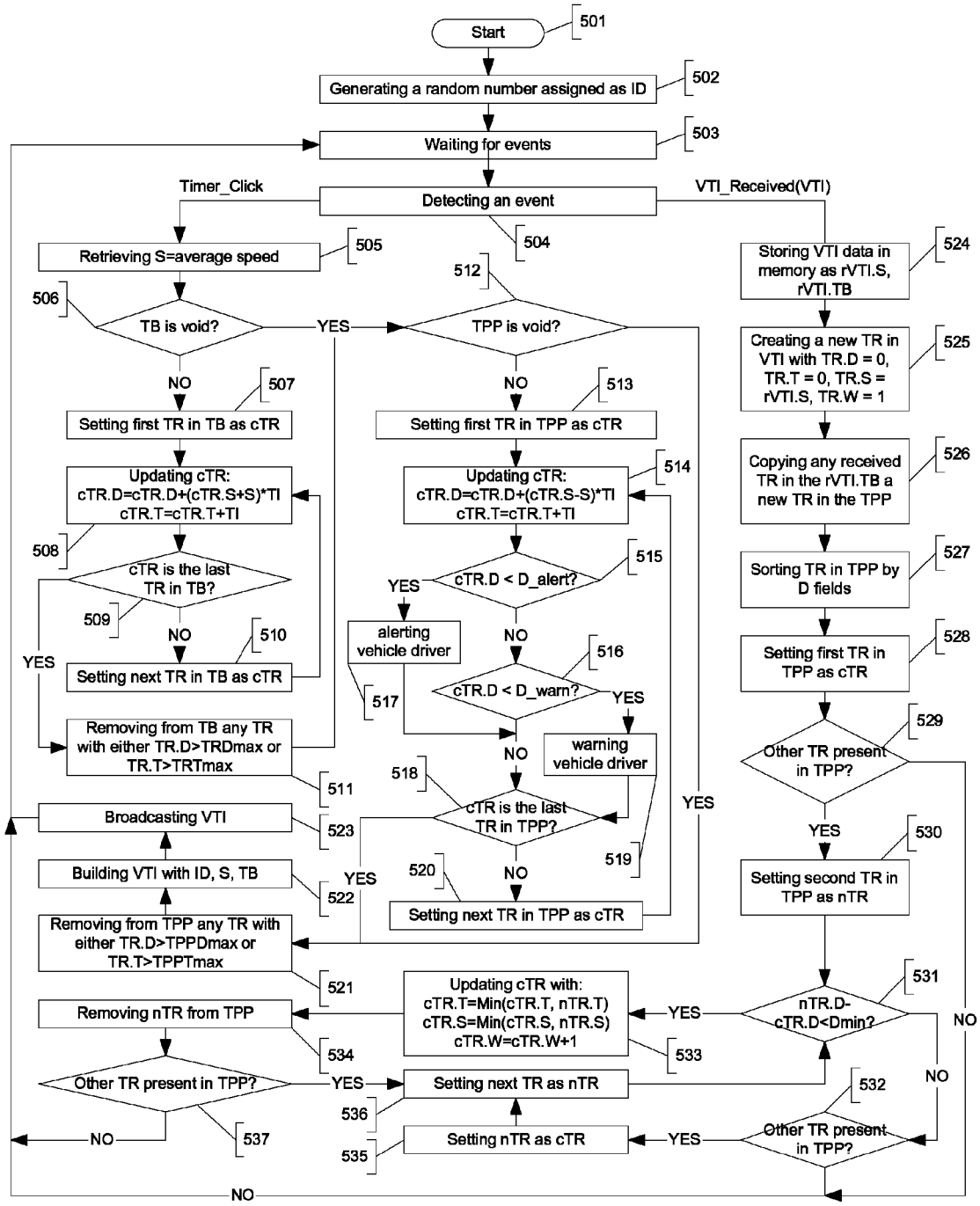
FIG. 5 is a flow chart of a method carried out by the traffic manager according to an embodiment of the present invention.

A method followed by the TM 400 corresponds to the logic described in the diagram shown in FIG. 5.

Event Detection

At 501, the method starts, typically when the whole TM is powered on. At 502, a random number is first generated, and then assigned as being the identifier ID of the TM. Conventional means are assumed for generating this random number. At 503, the method enters a waiting state, expecting events to occur. At 504, an event has been detected. If the event is the reception of a "Timer_Click" from the clock manager 405, then control is given to 505. If the event is the reception of a "VTI_Received(VTI)" from the radio transponder 401, then control is given to 524.

Reception of a "Timer_Click"

At 505, the TM retrieves through the vehicle interface 406, the vehicle speed and assigns it to the field S 202. In an embodiment of the present invention, the passed value corresponds to the vehicle average speed since the last interrogation. At 506, a test is performed to check if the traffic book TB 203 is void. If it is the case, then control is given to 512; otherwise control is given to 507.

Traffic Book TB

At 507, the first traffic record TR 210 of the traffic book TB 203 is set as being the current traffic record cTR. At 508, the current traffic record cTR is updated. First, the distance field D 211 is incremented with the product of the time interval TI by the sum of the vehicle speed S 202 and of the cTR speed field 213. Second, the time field T 212 is incremented with the time interval TI. At 509, a test is performed to check if the current traffic record cRT is the last traffic record TR 210 in the traffic book TB 203. If it is the case, then control is given to 511; otherwise control is given to 510.

At 510, the next traffic record TR 210 following the cRT in the traffic book TB 203, becomes the new current traffic record cRT. Then control is given to 508. At 511, an housekeeping operation is performed within the traffic book TB 203 by removing any traffic record TR 210 with either a distance field D 211 above a fixed threshold TRDmax, or with a time field T 212 above a fixed threshold TRTmax.

Traffic Prediction Pattern TPP

At 512, a test is performed to check if the TPP is void. If it is the case, then control is given to 521; otherwise control is given to 513. At 513, the first traffic record TR 210 of the traffic prediction pattern TPP is set as being the current traffic record cTR. At 514, the current traffic record cTR is updated. First, the distance field D 211 is incremented with the product of the time interval TI by the difference between the cTR speed field 213 and the vehicle speed S 202. Second, the time field T 212 is incremented with the time interval TI.

At 515, a test is performed to check if the distance field D 211 is less than a fixed threshold D_alert. If it is the case, then control is given to 517; otherwise control is given to 516. At 516, a test is performed to check if the distance field D 211 is less than a fixed threshold D_warn. If it is the case, then control is given to 519; otherwise control is given to 518.

At 517, the vehicle driver is alerted through a visible or audible alerting message built by the user interface component 407. At 518, a test is performed to check if the current traffic record cRT is the last traffic record TR 210 in the traffic prediction pattern TPP. If it is the case, then control is given to 521; otherwise control is given to 520.

At 519, the vehicle driver is warned through a visible or audible warning message built by the user interface component 407. Then control is given to 518. At 520, the next traffic record TR 210 following the cRT in the traffic prediction pattern TPP, becomes the new current traffic record cRT. Then control is given to 514.

Broadcasting

At 521, an housekeeping operation is performed within the traffic prediction pattern TPP by removing any traffic record TR 210 with either a distance field D 211 above a fixed threshold TPPDmax, or with a time field T 212 above a fixed threshold TPPTmax. At 522, the VTI 200 is built from the fields ID 201, S 202 and TB 203. At 523, the VTI 200 is broadcast through the radio transponder 401. Then control is returned back to 503.

Reception of a Vehicle Traffic Information (VTI)

At 524, the speed S 202 field and the traffic book TB 203 field of the VTI received as argument of the VTI_Received (VTI) event are respectively recorded as local variables rVTI.S and rVTI.TB. At 525, a new traffic record TR 210 is created in the VTI 200 with the distance D 211 field set equal to 0 (zero), the time T 212 field set equal to zero, the speed S 213 field set equal to the local variable rVTI.S, and the weight W 214 field set equal to 1 (one).

At 526, a new traffic record TR 210 is created in the traffic prediction pattern TPP as a copy of any traffic record TR 210 received in the traffic book TB field 203 of the VTI 200. At 527, the traffic records TR 210 of the traffic prediction pattern TPP are sorted by their Distance D field 211. At 528, the first traffic record TR 210 of the traffic prediction pattern TPP is set as being the current traffic record cTR. At 529, a test is performed to check if another traffic record TR 210 is present in the traffic prediction pattern TPP. If it is the case, then control is given to 530; otherwise control is given to 503.

At 530, the second traffic record TR 210 of the traffic prediction pattern TPP is set as being the next traffic record nTR. At 531, a test is performed to check if the difference between the distance fields D 211 of the nTR and cTR traffic records is less than a fixed threshold Dmin. If it is the case, then control is given to 533; otherwise control I given to 532. At 532, a test is performed to check if another traffic record TR 210 is present in the traffic prediction pattern TPP. If it is the case, then control is given to 535; otherwise control is given to 503.

At 533, the current traffic record cTR is updated. First, the time T 212 field is replaced by the lowest value between the time T 212 fields of the current traffic record cTR and of the next traffic record nTR. Then, the speed S 213 field is replaced by the lowest value between the speed S 213 fields of the current traffic record cTR and of the next traffic record nTR. Finally the weight W 214 field is incremented by one (1).

At 534, the next traffic record nTR is removed from the traffic prediction pattern TPP. Then control is given to 537. At 535, the next traffic record nTR becomes the new current traffic record cRT. At 536, the next traffic record TR 210 following the nRT in the traffic prediction pattern TPP, becomes the new next traffic record nRT. Then control is given to 531. At 537, a test is performed to check if another traffic record TR 210 is present in the traffic prediction pattern TPP. If it is the case, then control is given to 536; otherwise control is given to 503.

While the invention has been particularly shown and described with reference to a preferred embodiment, it will be understood that various changes in form and detail may be made therein without departing from the spirit, and scope of the invention.

What is claimed is:

1. A method executed in a vehicle, for predicting traffic conditions based on traffic information exchanged using short range wireless communications, between vehicles moving in opposite directions, the method comprising:

successively recording traffic information based on traffic encountered by the vehicle;

sending the traffic information to vehicles moving in the opposite direction;

receiving traffic information from vehicles moving in the opposite direction;

consolidating the traffic information received from the vehicles moving in the opposite direction; and predicting traffic conditions based on the consolidated traffic information;

wherein the traffic information for each vehicle comprises:

an identifier of the vehicle;

an indication of a speed of the vehicle; and data related to traffic successively encountered by the vehicle, wherein the data related to traffic successively encountered by the vehicle comprises at least one traffic record, each traffic record comprising:

a time or a time interval from a reference time;

an indication of a speed of a vehicle moving in the opposite direction at the reference time; and an indication of a distance from the vehicle to the vehicle moving in the opposite direction at the reference time.

2. The method according to claim 1, wherein predicting traffic conditions further comprises:

informing a driver of the predicted traffic conditions.

3. The method according to claim 1, wherein predicting traffic conditions further comprises:

alerting a driver of the occurrence of abnormal traffic conditions.

4. The method according to claim 1, wherein sending the traffic information to vehicles moving in the opposite direction further comprises:

continuously updating the traffic information which is broadcast to the vehicles.

5. The method according to claim 1, further comprising:

removing at least one traffic record according to at least one predefined criteria.

6. The method according to claim 5, wherein the at least one predefined criteria is based on at least one of time and distance.

7. The method according to claim 1, further comprising:

generating a random number; and using the random number for assigning a unique identifier to the vehicle.

8. The method according to claim 1, further comprising mounting a wireless communication system at a front of the vehicle for sending or receiving data from vehicles moving in the opposite direction.

9. The method according to claim 1, wherein sending the traffic information to vehicles moving in the opposite direction further comprises:

continuously broadcasting the traffic information.

10. A system in a vehicle, for predicting traffic conditions based on traffic information exchanged using short range wireless communications, between vehicles moving in opposite directions, comprising:

a system for successively recording traffic information based on traffic encountered by the vehicle;

a system for sending the traffic information to vehicles moving in the opposite direction;

a system for receiving traffic information from vehicles moving in the opposite direction;

a system for consolidating the traffic information received from the vehicles moving in the opposite direction; and a system for predicting traffic conditions based on the consolidated traffic information;

wherein the traffic information for each vehicle comprises:

an identifier of the vehicle;

an indication of a speed of the vehicle; and data related to traffic successively encountered by the vehicle, wherein the data related to traffic successively encountered by the vehicle comprises at least one traffic record, each traffic record comprising:

a time or a time interval from a reference time;

an indication of a speed of a vehicle moving in the opposite direction at the reference time; and an indication of a distance from the vehicle to the vehicle moving in the opposite direction at the reference time.

11. The system according to claim 10, wherein the system for predicting traffic conditions further comprises:

a system for informing a driver of the predicted traffic conditions.

12. The system according to claim 10, wherein the system for predicting traffic conditions further comprises:

a system for alerting a driver of the occurrence of abnormal traffic conditions.

13. The system according to claim 10, wherein the system for sending the traffic information to vehicles moving in the opposite direction further comprises:

a system for continuously updating the traffic information which is broadcast to the vehicles.

14. The system according to claim 10, further comprising:

a system for removing at least one traffic record according to at least one predefined criteria.

15. The system according to claim 14, wherein the at least one predefined criteria is based on at least one of time and distance.

16. The system according to claim 10, further comprising:

a system for generating a random number; and a system for assigning a unique identifier to the vehicle using a random number.

17. The system according to claim 10, further comprising:

a wireless communication system mounted at a front of the vehicle for sending or receiving data from vehicles moving in the opposite direction.

18. The system according to claim 10, wherein the system for sending the traffic information to vehicles moving in the opposite direction further comprises:

a system for continuously broadcasting the traffic information.

19. A program product stored on a computer readable medium, which when executed, predicts traffic conditions based on traffic information exchanged using short range wireless communications, between vehicles moving in opposite directions, the computer readable medium comprising program code for:

successively recording traffic information based on traffic encountered by the vehicle;

sending the traffic information to vehicles moving in the opposite direction;

receiving traffic information from vehicles moving in the opposite direction;

consolidating the traffic information received from the vehicles moving in the opposite direction; and predicting traffic conditions based on the consolidated traffic information;

wherein the traffic information for each vehicle comprises:

an identifier of the vehicle;

an indication of a speed of the vehicle; and data related to traffic successively encountered by the vehicle, wherein the data related to traffic successively encountered by the vehicle comprises at least one traffic record, each traffic record comprising:

a time or a time interval from a reference time;

an indication of a speed of a vehicle moving in the opposite direction at the reference time; and an indication of a distance from the vehicle to the vehicle moving in the opposite direction at the reference time.

* * * * *